US012084949B2

(12) United States Patent
Reilly et al.

(10) Patent No.: US 12,084,949 B2
(45) Date of Patent: Sep. 10, 2024

(54) INTERVENTION SYSTEM AND METHOD USING WELL SLOT PATH SELECTOR VALVE

(71) Applicant: Baker Hughes Energy Technology UK Limited, Bristol (GB)

(72) Inventors: Gavin Reilly, Aberdeen (GB); Peter Welsh, Aberdeen (GB); Lee Mainprize, Aberdeen (GB)

(73) Assignee: Baker Hughes Energy Technology UK Limited, Bristol (GB)

( * ) Notice: Subject to any disclaimer, the term of this patent is extended or adjusted under 35 U.S.C. 154(b) by 58 days.

(21) Appl. No.: 17/892,870

(22) Filed: Aug. 22, 2022

(65) Prior Publication Data

US 2023/0060921 A1 Mar. 2, 2023

Related U.S. Application Data

(60) Provisional application No. 63/237,453, filed on Aug. 26, 2021.

(51) Int. Cl.
*E21B 43/017* (2006.01)

(52) U.S. Cl.
CPC ..... *E21B 43/0175* (2020.05)

(58) Field of Classification Search
CPC ..... E21B 43/0175
See application file for complete search history.

(56) References Cited

U.S. PATENT DOCUMENTS

| | | | | |
|---|---|---|---|---|
| 7,793,724 | B2 | 9/2010 | Daniel | |
| 10,400,528 | B2 * | 9/2019 | Kalia | E21B 43/12 |
| 10,570,719 | B2 | 2/2020 | Zaragoza Labes | |
| 10,663,085 | B2 | 5/2020 | Pinho | |
| 11,053,746 | B2 | 7/2021 | Rageot | |
| 11,352,857 | B2 * | 6/2022 | Stokke | E21B 34/00 |
| 11,486,217 | B2 * | 11/2022 | Riley | E21B 34/04 |
| 2002/0066559 | A1 | 6/2002 | Hamilton | |
| 2004/0144543 | A1 * | 7/2004 | Appleford | E21B 43/36 166/336 |

(Continued)

FOREIGN PATENT DOCUMENTS

| | | |
|---|---|---|
| CN | 107023274 | 8/2017 |
| GB | 2572484 | 10/2019 |

(Continued)

OTHER PUBLICATIONS

Fernando C. Hernandez et al., "Engineering for Mexico's deepwater developments," Mar. 1, 2017, Offshore Engineer, 5 pages.

(Continued)

*Primary Examiner* — Aaron L Lembo
(74) *Attorney, Agent, or Firm* — Baker Hughes Company

(57) ABSTRACT

A system to be used with one or more well slots in an oil and gas operation is disclosed. At least one manifold is associated with the one or more well slots and with first passage-ways for the one or more well slots. An intervention subsystem includes second passage-ways and a path selector valve. The path selector valve is selectable to associate together at least two of the second passage-ways, which enables a maintenance action to be performed for an intended well slot of the one or more well slots.

20 Claims, 11 Drawing Sheets

(56) References Cited

U.S. PATENT DOCUMENTS

| | | | |
|---|---|---|---|
| 2017/0241243 | A1 | 8/2017 | Gomes Martins |
| 2020/0399998 | A1 | 12/2020 | Laing |

FOREIGN PATENT DOCUMENTS

| | | |
|---|---|---|
| WO | 2019/170296 | 9/2019 |
| WO | 2021/052632 | 3/2021 |

OTHER PUBLICATIONS

Joseph Zawacki, "Wellsite valve manifolds simplified," Apr. 5, 2018, Oil and Gas Engineering, 7 pages.
International Search Report and Written Opinion mailed Dec. 12, 2022 in corresponding PCT Application No. PCT/EP22/25392.

* cited by examiner

INTERVENTION SYSTEM AND METHOD USING WELL SLOT PATH SELECTOR VALVE

CROSS-REFERENCES TO RELATED APPLICATIONS

This application is related to and claims the benefit of priority from U.S. Provisional Application 63/237,453, titled INTERVENTION SYSTEM AND METHOD USING WELL SLOT PATH SELECTOR VALVE, filed Aug. 26, 2021, the entire disclosure of which is incorporated by reference herein for all intents and purposes.

BACKGROUND

1 Field of Invention

This disclosure relates in general to drill center interventions in oil and gas operations, and in particular to an intervention subsystem to select one or more well slots for intervention and to promote remote production assurance activities.

2. Description of the Prior Art

Structures used in oil and gas operations may include fluid inlets and outlets associated with pipes, such as an umbilical or jumpers, to receive and to pass production fluid. Such production fluid may be secured from oil and gas operations at drill sites and may be sent back to a surface area from a subterranean or subsea area. Such production fluids may be caused to flow in an intended direction using one or more valves. In a subsea area, a floating structure or platform may be provided to enable flow, to and from a well slot, of a production fluid. In the event of an intervention required for a well slot at the drill site, access may be provided at each well slot via pipes and associated valves. A well slot may support a Christmas trees structure of an oil and gas operation and is a sophisticated and pressure-intensive work site. As such, over a life of field (LOF) measure for a drill site having multiple well slots, targeting each well slot with specific equipment, when required for various operation, may turn into a process-intensive operation.

SUMMARY

In at least one embodiment, a system to be used with one or more well slots in an oil and gas operation is disclosed. In the system, at least one manifold is associated with the one or more well slots and is associated with first passage-ways for the one or more well slots. An intervention subsystem includes second passage-ways and a path selector valve. The path selector valve is selectable to associate together at least two of the second passage-ways, which enables a maintenance action to be performed for the one or more well slots through at least part of the first passage-ways.

In at least one embodiment, a method to be used with multiple well slots in an oil and gas operation is disclosed. The method includes associating at least one manifold with a number of well slots and with first passage-ways for the well slots. The method includes enabling an intervention subsystem to interface with the at least one manifold. The intervention subsystem includes second passage-ways and a path selector valve. Further, the method includes enabling a selector for the path selector valve so that the selector can associate together at least two of the second passage-ways. The association together of the at least two of the second passage-ways can cause a maintenance action to be performed for an intended well slot of the multiple well slots through at least part of the first passage-ways.

In at least one embodiment, a further method to be used with multiple well slots in an oil and gas operation is disclosed. In at least one embodiment, the method includes providing at least one manifold to be associated with first passage-ways for a number of well slots. The method includes selecting, using a selector of an intervention subsystem, to associate together at least two second passage-ways of the intervention subsystem through a path selector valve. The association together of the at least two of the second passage-ways can cause a maintenance action to be performed for an intended well slot of the multiple well slots through at least part of the first passage-ways.

BRIEF DESCRIPTION OF THE DRAWINGS

Various embodiments in accordance with the present disclosure will be described with reference to the drawings, in which.

DETAILED DESCRIPTION

Figure 1:
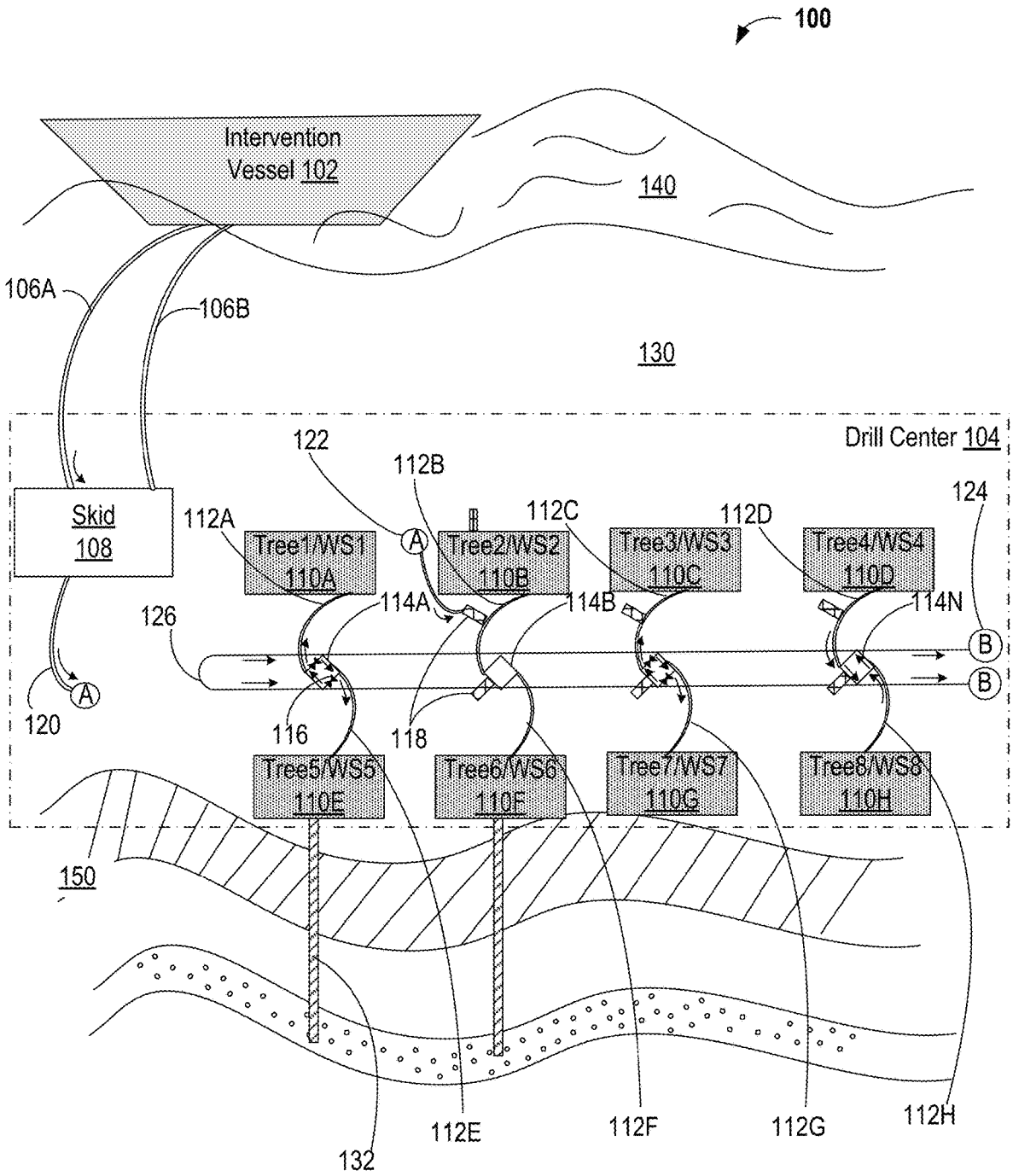
FIG. 1 illustrates an example system of an oil and gas operation that can be subject to aspects of at least one embodiment herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In at least one embodiment, a system and method herein address issues where it may be difficult to predict operational requirements to maintain production assurances over a life of field (LOF) measurement for a well site when an oil and gas operation is being conducted or to be conducted. Further, reservoir conditions and production fluid properties are subject to change during and in preparation of such oil and gas operations. These chances can lead to unforeseen production flow issues, such as, due to contaminant blockages/restrictions within components of a manifold, including within well jumpers, service and production lines, other flowlines and service lines, or fluid blocks therein. A fluid block may include a diamond block or other-shaped block structures having passage-ways and/or isolation valve chambers therein to pass production and intervention fluid to a bore.

Such a system and method can also address intervention requirements to maintain recovery targets for multiple well slots. Where issues can be determined ahead of time, such a system and method can be used to address previously bespoke and/or "single purpose" permanently-installed chemical injection distribution networks, that were used to serve a known future mitigation strategy. As such, solutions herein provide a less complex and economical solution other than such bespoke and/or single purpose features. Still further, a system and method herein can also be used in situations where infrequent chemical treatments, such as scale squeeze may be required, over an LOF, to maintain production target. In such situations, previously, an operator would be required to consider provisions of a chemical distribution network, all the way from topsides to point-of-delivery in a permanently-installed equipment on each well slot. Another consideration previously required was to depressurize production flowlines and to facilitate jumper retrieval, where such jumpers are used between well slots and production manifolds at a well site. In at least one embodiment, a system having an intervention subsystem can therefore reduce operator risk, while enabling future low cost, highly efficient LOF intervention activities, which leads to minimizing total operating expenditure and carbon footprint over the LOF for a clustered well drill center (DC)-based production system.

Further, such a system and method having an intervention subsystem herein can be configured to provide access to multiple wells (at multiple well slots) clustered around a production manifold of a drill center. Such system that includes an intervention subsystem provides such access from a single hot stab tie-in facility mounted on the production manifold, which is also referred to herein as a manifold. The manifold may include a fluid block, such as a diamond or other shaped block having passage-ways therein and that include isolation valves, inlets, and outlets for production fluids.

The intervention subsystem includes or is associated with one or more valves and can include or be associated with an arrangement of such one or more valves. The one or more valves include barrier valves, a bore selector path selector valve (also referred to as a path selector valve) and well slot check valves (also referred to as a check valve). The check valves can provide the intervention fluid access for a fluid block, distinct from the inlets and outlets provided for production fluid.

The system, by such an arrangement of one or more valves associated with an intervention subsystem is able to minimize a number of valves otherwise necessary to provide well slot isolation required with respect to each well slot when targeting each well slot with specific equipment for various operations, and therefore may be part of a solution to such aforementioned process-intensive operation. The size, weight, complexity, and cost of a system having a manifold and coupled to one or more well slots are reduced using an intervention subsystem with or without an isolation valve arrangement. The intervention subsystem is able to provide an operator with a low-cost alternative that can support maintenance activities (such as, chemical treatments, depressurization, checking integrity) on the manifold and well jumpers, over the LOF.

In at least one embodiment, the intervention subsystem enables a centralized system that is a single-point access system for multiple well slots. This feature also minimizes total expenses (TOTEX) associated with maintenance expenditure over the LOF of a clustered well production system. Further, the arrangement herein is able to use industry-rated hot stab tie-ins, barrier valves, path selector valves, well slot check valves, and a piping network integrated within a manifold. This, therefore, can reduce requirements to enable deployment to support future improved oil recovery (IOR) relating to intervention activities.

Features herein are described to address one or more of the above-referenced deficiencies. Various other functions can be implemented within the various embodiments as well as discussed and suggested elsewhere herein.

For example, a system to be used with one or more well slots in an oil and gas operation is disclosed. In the system, at least one manifold in a drill center is associated with the one or more well slots. The at least one manifold includes first passage-ways, such as through a fluid block or through jumpers associated with the fluid block. An intervention subsystem includes second passage-ways and a path selector valve. The path selector valve is selectable to associate together at least two of the second passage-ways, which enables a maintenance action to the one or more well slots.

An intervention subsystem provides a single intervention point and its associated functionality, such as minimizing a number of subsea tie-in operations that may be otherwise required to enable access to a well slot. Such an intervention subsystem also at least minimizes movements otherwise required for an ROV and any related support vessel to access production well slots at a well site. The intervention subsystem provides an operator with a low-cost feature that can be used to locally support production commissioning and maintenance activities on drill center (DC) equipment over the LOF of such a well site. Furthermore, the application of the intervention subsystem can be further enhanced to cover field expansion activities through use of D/S header valves that can be added in at least one embodiment.

In at least one embodiment, a system having an intervention subsystem improves functionality of a well site over an LOF utilizing the centralized tie-in facility to provide a single point access to the production bores associate with a drill center. In particular, the use of a selector valve associated with production well bores, with a well site, or with well slots, without a need to independently set up and control multiple access points associated with each production well bore, with a well site, or within each well slots is an improvement over injection or intervention otherwise provided by such multiple access points.

Furthermore, it is difficult to predict all operational requirements to maintain production assurance over an LOF, in view of reservoir conditions and produced fluid properties being subject to change that can lead to unforeseen production flow issues due to contaminant blockages/restrictions within production and service bores of a drill center. As such, a single point intervention enables production recovery targets to be met by singular actions or inputs associated with maintenance actions at an intervention subsystem rather than at each access point in a drill center. A cost of specialized intervention to "break in" to a production bore (also referred to as a bore) or costs associated with shutting down a drill center to gain access to individual bores, along with a requirement for specialized equipment is performing such tasks is cumulatively disruptive, complex, and expensive. As already described, where issues can be predicated, it is possible to provide bespoke or "single purpose" aspects to serve a known future mitigation strategy, which are also complex and expensive.

FIG. 1 illustrates an example system 100 of an oil and gas operation that can be subject to aspects of at least one embodiment herein. A subsea location 130 may be located above a well completion 150 that extends from a sub-seabed location to a seabed and that terminates in one or more Christmas trees 110A-H. As such, while eight Christmas trees are illustrated in the figure, there may be fewer than eight, such as six Christmas trees, each having its own bore 132.

Each Christmas tree (also referred to as tree) is associated with a well slot (WS). As such, a tree and a well slot is interchangeably used unless indicated otherwise. One or more such trees or well slots1-8 110A-H may be associated with one of multiple subsea fluid blocks 114A-N, within one or more manifolds, via a respective production well jumper 112A-H. One or more of such fluid blocks 114A-N may be associated with a manifold and may be included within a drill center 104. A drill center may be associated with one or more headers 108, which are, in turn, associated with an intervention vessel 102 via respective risers 106A, B. One riser 106A may be used for one or multiple fluid flows and another riser 106B may be used as a control umbilical to communicate electrical, mechanical, pneumatic, or fluid controls from an intervention vessel 102 to one or more subsea structures of a drill center 104.

While FIG. 1 illustrates an intervention vessel 102, which may be a ship or a barge that is on a surface of a sea 140, a person of ordinary skill can appreciate that at least one embodiment herein may be used with terranean and subterranean structures having similar trees, well slots, manifolds, and drill centers. Further, such subsea structures in a drill center 104 may be associated with flow pipes, sometimes referred to or included within risers, jumpers, an umbilical, or other flexible pipe systems. Such flow pipes can transport production and service fluids, but can also transfer other such fluids, such as, intervention fluid, associated with an oil and gas operation, that is between an intervention vessel 102 (and/or a land area) and the structures of a drill center 104.

While FIG. 1 illustrates multiple fluid blocks 114A-N, bores 132, and jumpers 112A-H, access to these features during operations may require individual control asserted at individual tie-ins 122 to provide (or activate) individual access points 118 of each of such fluid blocks, passageways, bores, jumpers, or other features of a drill center. Further, only example access points 118 are illustrated, but similar access points 118 representations drawn in the figure, but that are unmarked, are understood to pertain to other locations in a drill center where such access pints may be provided. FIG. 1 illustrates only example ones of such tie-ins and/or access points, but there may be numerous other such access points and associated tie-ins that may exist or that may be created in real time to access other parts of a well site. Such tie-ins and access points enable creation of different fluid flow paths at many different types of subsea structure in a drill center 104, where multiple inputs are required to enable access to one or more flow paths, including using valves 116 to ensure that access to an intended flow path is achieved.

Further, a first flow path (illustrated by arrows) of a loop 126 includes connected header valves "B" 124 (or pipeline end terminals (PLETs)) associated with a header that is other than a header 108 that may be associated with an intervention subsystem. Alternatively, header valves "B" 124 enable association with further fluid blocks downstream of a last fluid blocks 114N, as illustrated. When there are no further manifolds "B" is a reference to a PLET. In at least one embodiment, the header valves 124 are associated with oil, gas, or a production fluid that is other than intervention fluids used by an intervention subsystem. A separate header 108 is associated with a chemical or other jumper 120 to provide a second flow path via connecters "A" (of a chemical jumper 120 and of a tie-in 122) and to enable other similar connecters coupled together. The other connectors coupled together may include or may represent different access points (having different tie-ins) for different passageways within provided fluid blocks 114A-N or for different production well jumpers 112A-H.

In each of the provided fluid blocks 114A-N, fluid flow from a first flow path and from a second flow path are illustrated by the arrows on a loop 126 and within a fluid block 114A. T arrows provided within the fluid block and the arrows associated with the production well jumpers 112A-H may represent production fluid movement as well as intervention fluid movement, when intervention fluid is provided through an access point to the fluid block 114A, for instance. In an example, production fluids flow from bores 132 of associated WS 110A-H, through a loop or line 126, through the production well jumpers 112A-H, and is then supplied to production or host facilities that are all distinct from the intervention subsystem. A production well header may also be part of such a first fluid flow associated with service or production fluid. Further, instead of a loop 126, each line in the loop 126 may represent a separate line to carry production fluid to a production or host facility via header valves "B" 124 and a separate header.

Fluids from an intervention process may be provided via each access point by activating each access point 118 and by controlling valves 116 of the fluid blocks. This may represent a second flow path. While a first flow path may be kept distinct from a second flow path, a mixing may be anticipated where an access point 118 is enabled and activated to cause a tie-in 122 to allow intervention fluid flow through a line having production or server fluid, once the system 100 is associated with an intervention subsystem.

Figure 2:
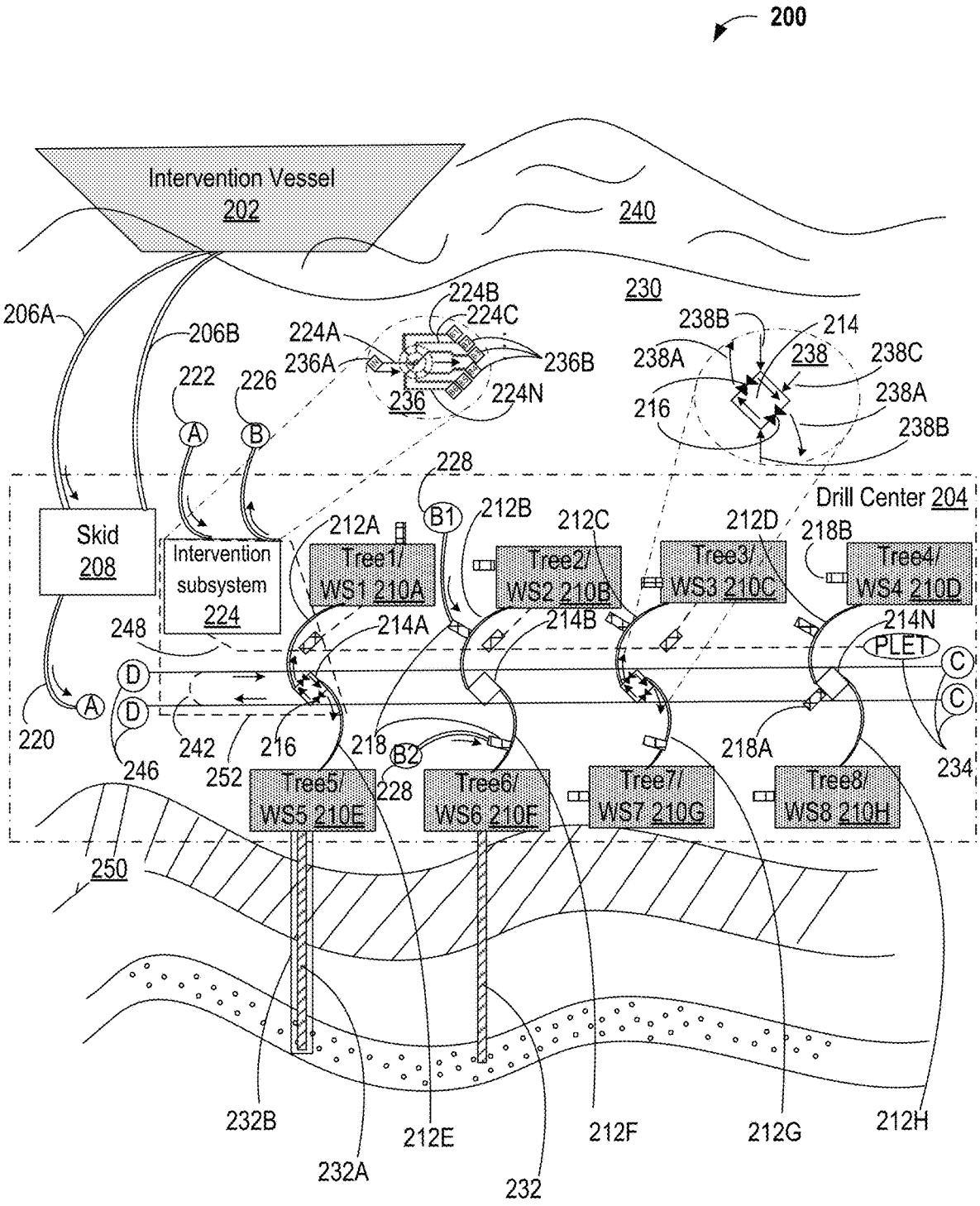
FIG. 2 illustrates a system having an intervention subsystem and to be used with one or more well slots in an oil and gas operation, in accordance with at least one embodiment.

FIG. 2 illustrates a system 200 having an intervention subsystem 224 and to be used with one or more well slots in an oil and gas operation, in accordance with at least one embodiment. Distinctly than in FIG. 1, the intervention subsystem 224 includes a path selector valve 236 that can receive an intervention fluid from a skid 208 (such as, a subsea skid or a safety package), via a chemical jumper 220, 222 and an intake tie-in 236A, and that can pass on such a intervention fluid to one or more tie-ins B1-B6 236B that may have respective access points tie-in on a receiving side. In doing so, such a system 200 enables interfacing with different fluid blocks 214A-N of different manifolds, accessing different production well jumpers 212A-H, accessing different trees or well slots1-8 212A-H, and accessing different bores 232, all by a singular input to a selector. Such a singular input may be a selection performed using a selector (as described in at least FIG. 6) associated with a path selector valve 236 of an intervention subsystem 224.

The selection enables selection of a path for an intervention fluid from an intervention subsystem 224 to any access point 218 associated with provided tie-ins B1-B6 228 and, subsequently, to any of different fluid blocks 214A-N, different production well jumpers 212A-H, different trees or well slots1-8 212A-H, and different bores 232. As such, there is no requirement for multiple inputs for each access points to enable a maintenance action there through for different fluid blocks 214A-N, different production well jumpers 212A-H, different trees or well slots1-8 212A-H, and different bores 232.

As in the case of FIG. 1, two flow paths may exist; differently, however, a second flow path for an intervention fluid may exist through connecters or tie-ins "A" (of a chemical jumper 220 and of an access point associated with the tie-in "A" 222) associated together, through connectors or tie-ins "B" 226 and an intake tie-in 236A associated together, through the intake tie-in 236A, through a path selector valve 236, and through outlet tie-ins B to B6 (or more) 236B associated together with corresponding access points associated with tie-ins 228 located throughout a drill center 204. Internal passage-ways of such an intervention subsystem 224 and of a drill center 204, as discussed in the subsequent figures may also form part of a second flow path.

In FIG. 2, a subsea location 230 may be located above a well completion 250 that extends from a sub-seabed location to a seabed and that terminates in one or more trees 210A-H. As such, while eight trees are illustrated in the figure, there may be fewer than eight, such as six trees, or more than eight trees, but with each having its own bore 232. FIG. 2 also illustrates that an intervention subsystem 224 may be assembled into a multiple-intervention point drill center 104 (of FIG. 1) to then provide a layout of a single-intervention point drill center 204, as in FIG. 2.

As in the case of FIG. 1, each tree in FIG. 2 is associated with a well slot. One or more of such trees or well slots1-8 210A-H may be associated with one of multiple subsea fluid blocks 214A-N via a respective production well jumper 212A-H. As described, such features may be also part of a second flow path for intervention fluids that may be distinct from a first flow path for production or service fluids, such as enabled by a loop or lines 242 that may interface with a header leading to a host or a production facility that is separate from a skid 208 and the intervention subsystem. Further, such a loop or line 242 may include header valves "C" 234 (or PLETs) and a separation header to pass production fluid to a host or production facility or to terminate where required.

In at least one embodiment, header valves "C" or "D" 234, 246 may be associated with a respective production headers. As such, each line previously referred to a loop 242 may be a distinct line that is used to pass production fluid in any direction (through "C" or "D") to a production or host facility. For example, one of the lines may be used for passing production fluids from a production bore 232A to a production facility. In this case, one line may be used to pass production fluids from the bores 232 via certain first passage-ways of a fluid blocks 214, while a different line may be used to pass service fluids to a service bore 232B via a different first passage-ways of a fluid blocks 214. Further, such lines 242 may bypass the fluid blocks 214A-N entirely.

Further first passage-ways may exist in a manifold hosting such a fluid block 214. For example, production well jumpers 212A-H and service or production lines 248, 242 can also form first passage-ways therein. First passage-ways may therefore be any passage-ways that are associated with (such as within or indirectly linked to) a manifold 252, but may exclude any passageways within an intervention subsystem 224, even if the intervention subsystem 224 is within the manifold 252. In at least one embodiment, a service line 248 may be part of or may be distinct from a manifold 252. However, as the service line 248 is associate with the well bore (such as a service bore 232B) that is in turn associated with a manifold 210E, the service line provides a first passage-way for intervention fluid. A service bore may be an outer annular region from production bore and encased by a casing that also encases the production bore. Selector valves of the manifold may be used to enable such different first passage-ways so that there may be no mixing of fluids from a production bore purpose to a service bore purpose and vice-versa. As such, one or more intervention subsystems 224 may be able to support different bore access requirements as well.

In at least one embodiment, it is possible to use at least one service line 248 that passes through a manifold 252 and that extends from the intervention subsystem 224 to the different trees or WS 210A-H for passing service fluid to a service bore. Such a service line 248 may access the manifolds but may not be part of the fluid blocks. In at least one embodiment, however, one of the loop line 242 may be able to pass service fluids to a service bore 232B via a fluid block. The use of a service line 248 that is associated with an intervention subsystem 224, however, can enable a direct first passage-way line (bypassing a fluid block 214) to provide intervention fluid from an intervention subsystem to one or more of the trees or WS 210A-H through second passage-ways that is the service line 248 passing through or associated with the manifold 252. This feature at least enables direct access and service access to one or more trees or WS 210A-H while other trees or WS 210A-H are active in a production bore operation.

Provided fluid blocks 214A-N in FIG. 2 may be associated with one or more manifolds 252 within a drill center 204. An intervention subsystem 224 may be also associated with or may be included within a drill center 204. The drill center 204 may be associated with one or more skids 208, which are, in turn, associated with an intervention vessel 202 via respective risers 206A, B. One riser 206A may be used for one or multiple intervention fluid flows and another riser 206B may be used as a control umbilical to communicate electrical, mechanical, pneumatic, or fluid controls from a floating platform 202 to one or more subsea structures 204-228, 232-238, 242.

Like in FIG. 1, while FIG. 2 illustrates the intervention vessel 202, which may be a ship or a barge that is on a surface of a sea 240, a person of ordinary skill can appreciate that at least one embodiment herein may be used with terranean and subterranean structures having similar trees, well slots, skids, headers, and manifolds as part of a drill center. Further, such subsea structures 204-228, 232-238, 242 may be associated with flow pipes, sometimes referred to or included within risers, jumpers, an umbilical, or other flexible pipe systems. Such flow pipes can transport production, service, and intervention fluids that may be associated with an oil and gas operation. The intervention fluids may be provided between an intervention vessel 202 (and/or a land area) and the structures 204-228, 232-238, 242. Production and service fluid are provided via service and production lines but may be accessed by the intervention subsystem using the access points to these lines, as discussed herein.

FIG. 2 also illustrates that access to any of the provided fluid blocks 214A-N, access to the bores 232, and access to passage-ways associated with such fluid blocks (that may be within one or more manifolds of a drill center) does not require individual actions applied to individual access points 218 to provide (or activate) such access points of. Further, only example access points 218 are illustrated, but similar access points 218 representations drawn in the figure, but that are unmarked, are understood to pertain to other locations in a drill center where such access pints may be provided. Different that FIG. 1, individual tie-ins and their associated access points that may be elsewhere than illustrated or that may be created in real time to access parts of a drill center, may be also accessed by a singular action performed at an intervention subsystem 224 once an association is provided between such an access point, using its tie-in, and an available outlet tie-in 236B of an intervention subsystem 224.

A singular action, therefore, may include an adjustment to a selector (as described in at least FIG. 6) of an intervention subsystem 224 using an ROV input. The adjustment to a selector associates together at least a set of first passage-ways 224A-N to enable an intervention fluid to flow through inlet passage-way 224A and through an outlet passage-way 224B-N. The intervention fluid then flows through an established route that can include an intended one of the fluid blocks 214A-N, an intended one or more second passage-ways therein, an intended one of the trees or WSs 210A-H, and/or to an intended bore 232. In at least one embodiment, the intervention fluid is caused to reach a bore and may flush out any of an intended one of the first passageway-ways associated with one or more manifolds. This may be a maintenance action carried out using an intervention subsystem 224 and its path selector valve 236.

The tie-ins 222, 226, 228 may be stub-style tie-ins and at least the fluid block access points 218 are check valves. These tie-ins and access points enable creation of different fluid flow paths through many different types of subsea structure 204 where only a singular input (or at least lesser inputs than the number of access points) is required to enable access to a flow path having those access points. Indeed, fluid block isolation valves 216 may be set in position by default to ensure such singular action, but such action may not be required as an access point may be provided between passage-ways of a manifold, as illustrated and discussed with respect to other figures herein. The access points 218 may be check valves for a fluid block, to allow an intervention fluid from an intervention subsystem 224 there through.

Further, a first flow path (illustrated by arrows) of a loop 242 may be provided to connect header valves 234 to a header (leading to a production facility) that is distinct from a skid 208 associated with an intervention subsystem 224. In at least one embodiment, the header valves 234 are associated with oil, gas, service, or a production fluid that is other than an intervention fluid used by an intervention subsystem 224. In an example, gas lift may be used to provide gas pressure to support a fluid movement through a production bore. This enables reduction in pressure required to push production fluid out of a tree associated with a well slot.

A skid 208, however, may be associated with a chemical or other jumper 220 to provide a second flow path via header connecter "A" to connector "A" 222 of the intervention subsystem 224; and via a connector "B" 226 (that is made up of sub-connectors B1-B6 236A) and receiving connectors or tie-ins 228 (only B1 and B2 are illustrated) associated with various access points in a drill center. Such association between the "B" connectors 226; 236B may be based in part on a selection made to a selector associated with a path selector valve 236 of the intervention subsystem 224.

The second flow path supports intervention fluids associated with a maintenance action, including chemical treatment, a depressurization process, or a barrier integrity confirmation to be applied to the one or more well slots. Further, a maintenance action supported by the present system includes an action for an expansion of field process or an action to commissioning and maintaining well jumpers. In an example, intervention fluid may be used for local pressure testing in well slots when commissioning and maintaining well jumpers. In another example, a depressurization process may be used to remedy blocks in any pipeline of a drill center or of passage-ways of the fluid blocks using intervention fluids.

Furthermore, the receiving connecters or tie-ins 228 may represent different access points 218 (having check valves or that are check valves). Such connectors or tie-ins 228 are coupled to different passage-ways within provided fluid blocks 214A-N or to different production well jumpers 212A-H. In each of the provided fluid blocks 214A-N, fluid flow from a first flow path and from a second flow path may be encountered as illustrated by the arrows within a fluid block 214A-N and associated with the production well jumpers 212A-H. However, while a first flow path may be kept distinct from a second flow path, a mixing may be anticipated where an access point associated with a tie-in 222 is enabled and activated to cause a tie-in to allow fluid flow therethrough. Such mixed flow may be part of the flow paths 238A illustrated in call-out 238. Production fluid flow 238B into a fluid block 214 is provided from a first flow path associated with one or line or loop 242, while intervention fluid flow 238C into a fluid block occurs via access points that include check valves 218A.

Figure 3:
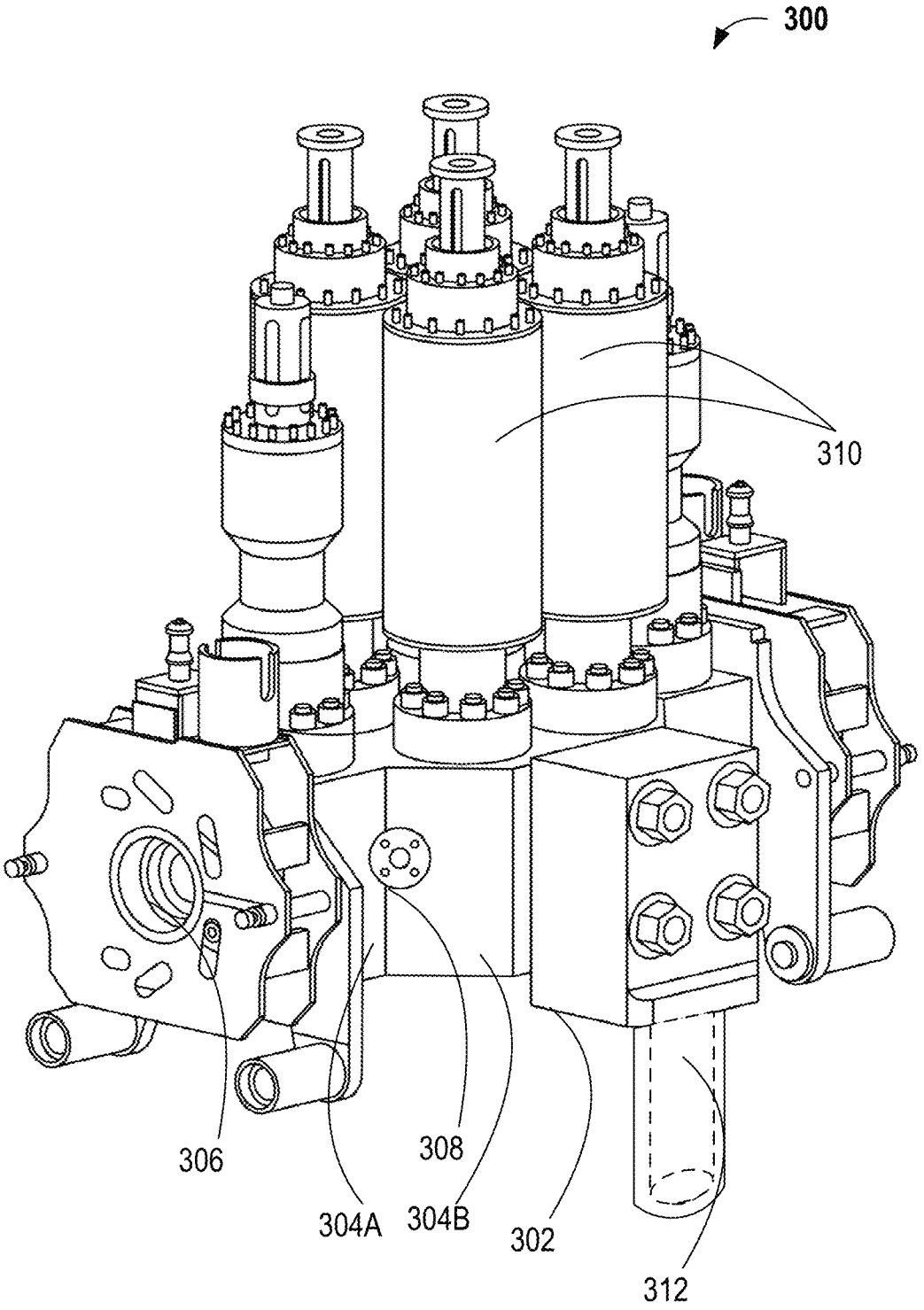
FIG. 3 is a perspective illustration of a system excerpt including a fluid block associated with an intervention subsystem to be used with one or more well slots in an oil and gas operation, in accordance with at least one embodiment.

FIG. 3 is a perspective illustration of a system excerpt 300 including a fluid block 302 associated with an intervention subsystem to be used with one or more well slots in an oil and gas operation, in accordance with at least one embodiment. The fluid block 302 is part of a system including an intervention subsystem to be used with one or more well slots in an oil and gas operation. The fluid block 302 may be part of a manifold within a drill center and may be associated with one or more well slots. The manifold may be a cage structure having components, including a fluid block 302 and an intervention subsystem therein. The fluid block 302 also has first passage-ways therein, such as through the fluid block itself or through a service line or production line that may be part of such a fluid block 302, before reaching an access point. The intervention fluid can therefore bypass a fluid block and can be caused to flow to a tree (such as, access point 218B if tree4/WS3 210D) via a service line 248. A production line bypassing a fluid block and allowing intervention fluid to reach a production bore is also similarly possible. In each case, however, selection of a path is made via an intervention subsystem 224 using the path selector valve 236 and these paths having associations to access points to these bypassing lines.

In at least one embodiment, multiple path selector valves 236 may be provided within an intervention subsystem. A first path selector valve may be provided to enable a second flow path that is through a fluid blocks 214A-N. The second path selector valve may be also used to allow a flow path to the first path selector valve and then through the fluid blocks 214A-N. This is so that the second path selector valve may be used a main path selector valve to bypass the first path selector valve and to allow selection of a service line 248 or a production line 242 to pass intervention fluid that also bypasses the fluid blocks 214A-N. Actions performed at an intervention subsystem 224 to select from two path selector valves is also fewer than the number of access points 218, 218A, 218B provided, and therefore remains a beneficial aspect of the disclosure herein.

FIG. 3 illustrates an inlet or intake 306 to allow fluids of a first flow path into the fluid block 302, such as, via a production well jumper. The fluid block 302 is a diamond block, but other fluid blocks having passageways and isolation valves may also be used with an intervention subsystem 224 and with check valves as described in FIG. 2. As described elsewhere herein, the first flow path may be associated with production fluids different from a second flow path associated with intervention fluids. However, FIG. 3 also illustrates a check valve 308 that is an access point or that is associated with an access point to allow intervention fluids of a second flow path into the fluid block 302. FIG. 3 also includes a flow path to a manifold header 312.

The fluid block 302 includes an angled feature, such as formed of two external surfaces 304A, B of the fluid block 302 forming an angle with each other. The angled feature is formed, internally, of one of the first passage-ways within the fluid block 302 and an inlet 306 of the fluid block 302. One external face 304A may encompass an inlet 306 and so, an angled feature may be described by internal or external aspects of a fluid block 302.

The angled feature may be enabled to support one of the check valves 308 of an intervention subsystem. A path selector valve of an intervention subsystem may be selectable to associate together at least two of the second passage-ways to enable a maintenance action to be performed for one or more of the well slots through at least part of the first passage-ways of the fluid block 302. For example, one maintenance action is to enable a flow of intervention fluid for the one or more well slots through at least part of the first passage-ways of the fluid block 302. Such a flow may be associated with a chemical treatment, a depressurization process, or a barrier integrity check for the one or more well sots. Such a flow can also be associated with an expansion of field study for a drill site or an action associated with commissioning and maintain well jumpers. As the well jumpers are associated with a well slot, a maintenance action to be performed for one or more of the well slots also applies to intermediate features leading to the well slot, such as a production well jumper.

Further, actuators 310 may be provided to support in-line maintenance or other access of a fluid block. Production well jumpers may be provided from flexible pipe systems that may be associated with an inlet and an outlet of such a fluid block. Such inlet, outlet, and production well jumpers leading to the trees or well slots may be part of the first fluid path, but may be accessed by the intervention subsystem using access points within the first fluid path.

Figure 4:
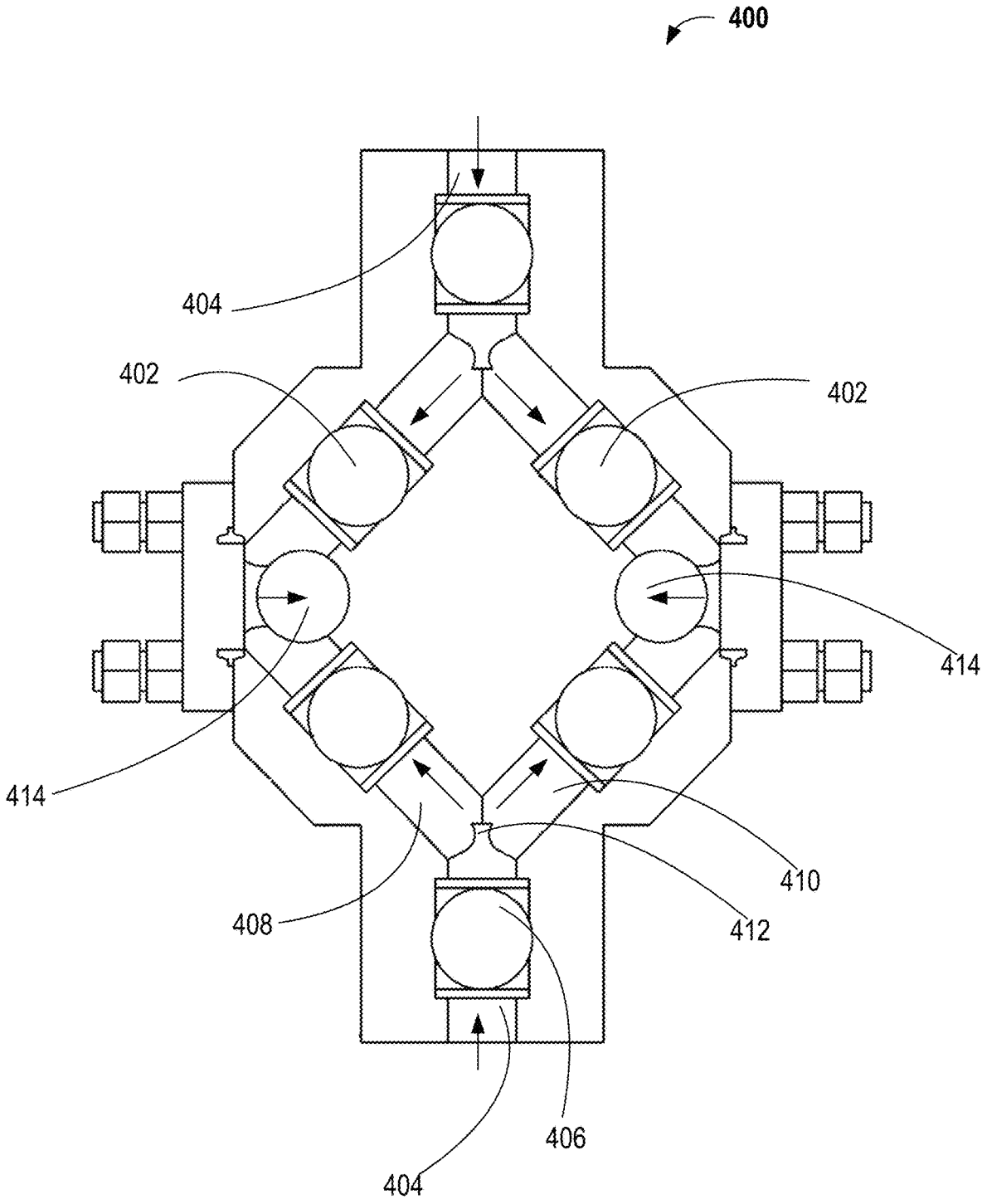
FIG. 4 is a plan illustration of a fluid block that may be within at least one manifold and that is to be associated with an intervention subsystem to be used with one or more well slots in an oil and gas operation, in accordance with at least one embodiment.

FIG. 4 is a plan illustration of a fluid block 400 that may be within at least one manifold and that is to be associated with an intervention subsystem to be used with one or more well slots in an oil and gas operation, in accordance with at least one embodiment. The fluid block 400 is part of a drill center that is associated with the one or more well slots. The fluid block 400 includes multiple first passage-ways 408, 410; selection valve chambers 402; inlets 404; outlets 414; isolation valve chambers 406; and shared or common root regions 412. In at least one embodiment, some of these valve chambers, and their associated valves are not provided, but separate passage-ways enable different fluid flow paths within the fluid block and to different trees or well sites. Such a fluid block 400 may be subject to the benefits of an intervention subsystem by installation of a check valve forming an access point to at least one of such first passage-ways 408; 410 therein.

Figure 5:
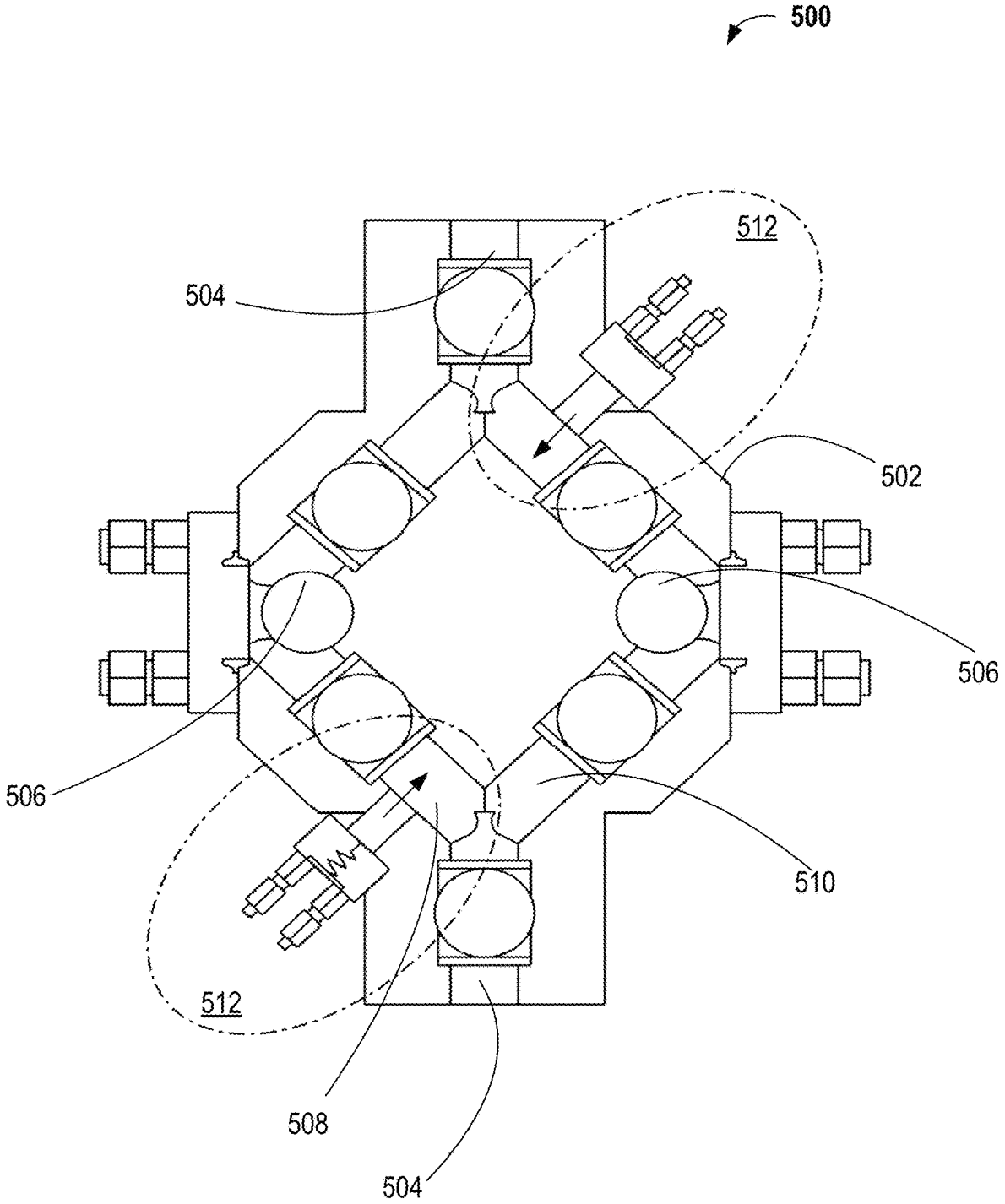
FIG. 5 is a plan illustration of a fluid block that may be within at least one manifold and that is associated with an intervention subsystem to be used with one or more well slots in an oil and gas operation, in accordance with at least one embodiment.

FIG. 5 is a plan illustration of a fluid block 500 that may be within at least one manifold and that is associated with an intervention subsystem to be used with one or more well slots in an oil and gas operation, in accordance with at least one embodiment. Check valves 512 are provided at angled features of the fluid block 500. The check valves 530 allow intervention fluid of an intervention subsystem into the fluid block 500. In at least one embodiment, access points are provided instead of check valves 512 or the check valves form the access point.

Separately, inlets 504 are provided for production or service fluid entry that is associated with either a service bore or a production bore. Outlets 506 provide such production fluid or other service and production bore fluid to and from the respective trees or well slots and, subsequently, to associated bores. In at least one embodiment, as described with respect to FIG. 4, isolation and selection valve chambers may be available in the fluid block 500 to enable distinct flow of the production fluid, through the first passage-ways, to two different well slots of the one or more well slots.

Figure 6:
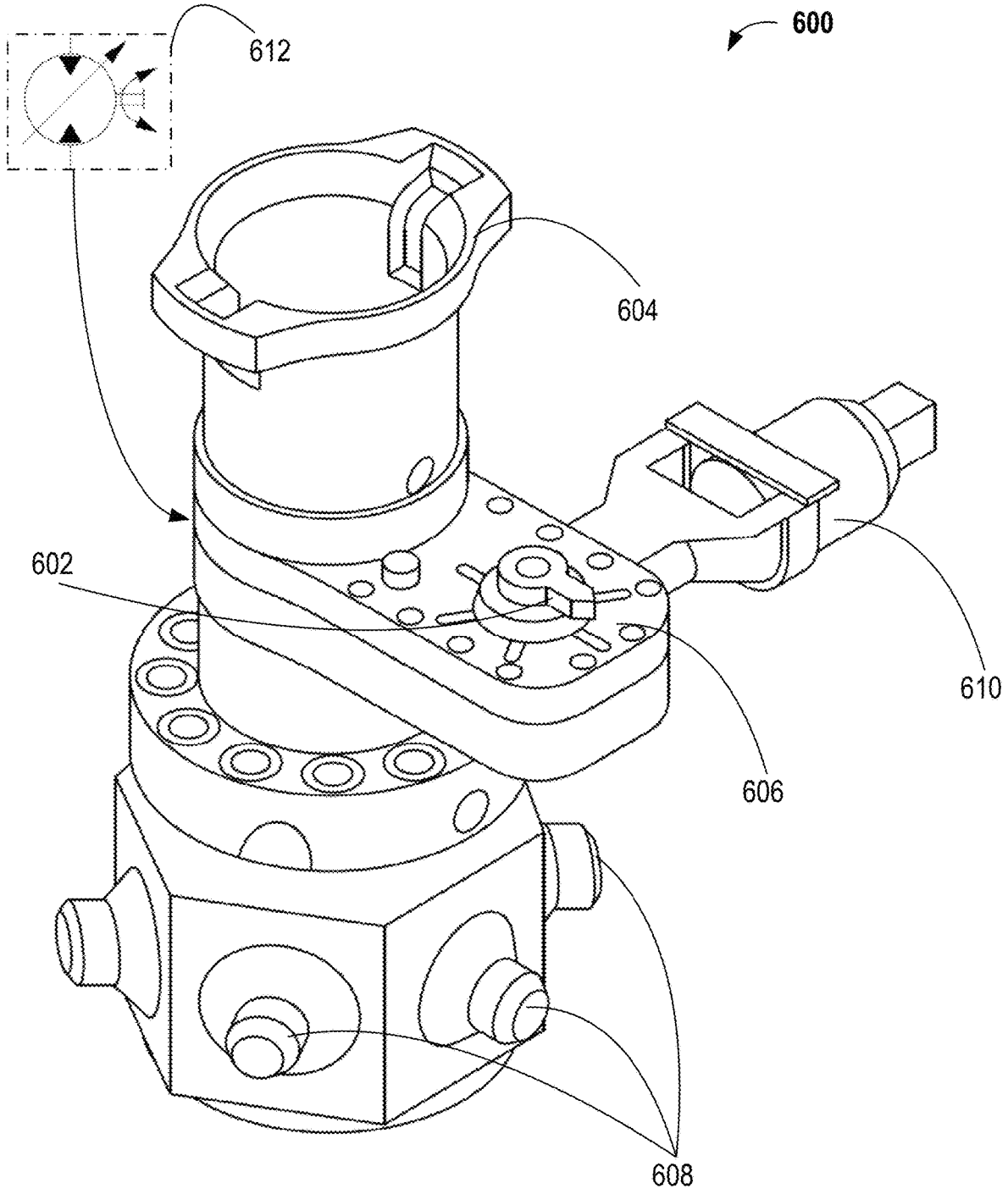
FIG. 6 is a perspective illustration of an intervention subsystem having a path selector valve to be used with well slots in an oil and gas operation, in accordance with at least one embodiment.

FIG. 6 is a perspective illustration of an intervention subsystem 600 having a path selector valve to be used with well slots in an oil and gas operation, in accordance with at least one embodiment. The intervention subsystem 600 includes second passage-ways from at least an intake port at a bottom of the intervention subsystem 600 to an outlet port 608 on a side of the intervention subsystem 600. A path selector valve is provided within the intervention subsystem 600 and is associated with a selector 604. The path selector valve, together with the selector 604, provides a selectable feature for the intervention subsystem 600. Adjustments to the selector 604 can associate together at least two of such second passage-ways by the underlying path selector valve. For example, the intake port is associated with one second passage-way that is distinct from the first passage-ways referenced in the fluid block.

Each outlet port 608 is associated with a respective second passage-way internally with respect to the intervention subsystem 600 and is associated with a respective check valve and associated first passage-way of a fluid block that is external to the intervention subsystem 600. Then, an association together of the intake-related second passage-way with one of the outlet-related second passage-ways 608 enables flow of intervention fluid applied at an intake port to the one or more well slots through at least part of the first passage-ways of the fluid block.

An identification of associated second passage-ways may be provided via markings 606 on top of the intervention subsystem 600. A position indicator 602 may be provided in association with the markings 606 on the intervention subsystem. The position indicator 602 may be used to indicate the association together of the at least two of the second passage-ways. The selector 604 of the intervention subsystem 600 enables the selectable feature and the associated path selector valve to be operated or adjusted via a remotely operable vehicle (ROV). For example, the path selector valve may have a handle or a socket to function as a selector 604 (or that may extend at an angle, but that may be part of the selector 604), which can be locked on to by an arm of an ROV or an electrical actuator system.

The ports, including outlet ports 608, on the intervention subsystem 600 therefore supports intake of the production fluid and outlet of such intervention fluid. At least two sets of the ports can enable the second passage-ways to the one or more well slots. However, the at least two sets of the ports may necessarily include the intake port, in at least one embodiment. Further, the ports of the intervention subsystem can be used to associate one or more of a production jumper well or a service jumper to the intervention subsystem.

In at least one embodiment, the path selector valve may be electrically actuated by an electrical actuator system 612 associated with the tab 606 or a separate tab opposite to the illustrated tab. As such, together with the selector 604, the electrical actuator system provides a selectable feature for the intervention subsystem 600. Adjustments to the selector 604 can be made by remote or local electrical signals provided to the electrical actuator system 612. Such remote or local electrical signals can cause the electrical actuator system 612 to move the selector 604, which in turn associates together at least two of such second passage-ways by the underlying path selector valve. For example, the intake port is associated with one second passage-way that is distinct from the first passage-ways referenced in the fluid block. In at least one embodiment, a subsea control module (SCM) may be used to provide such local electrical signals for controlling the selector 604.

Once the intervention fluid is passed from the intervention subsystem 600, check valves associated with at least one fluid block can receive the intervention fluid from the path selector valve and can pass the intervention fluid to the one or more well slots. Still further, the check valves are provided within at least one fluid block, so that the check valves can provide access to the first passage-ways as described with respect to at least FIG. 5. The access to the first passage-ways can allow a flow of the intervention fluid from the path selector valve of the intervention subsystem into the fluid block.

Figure 7:
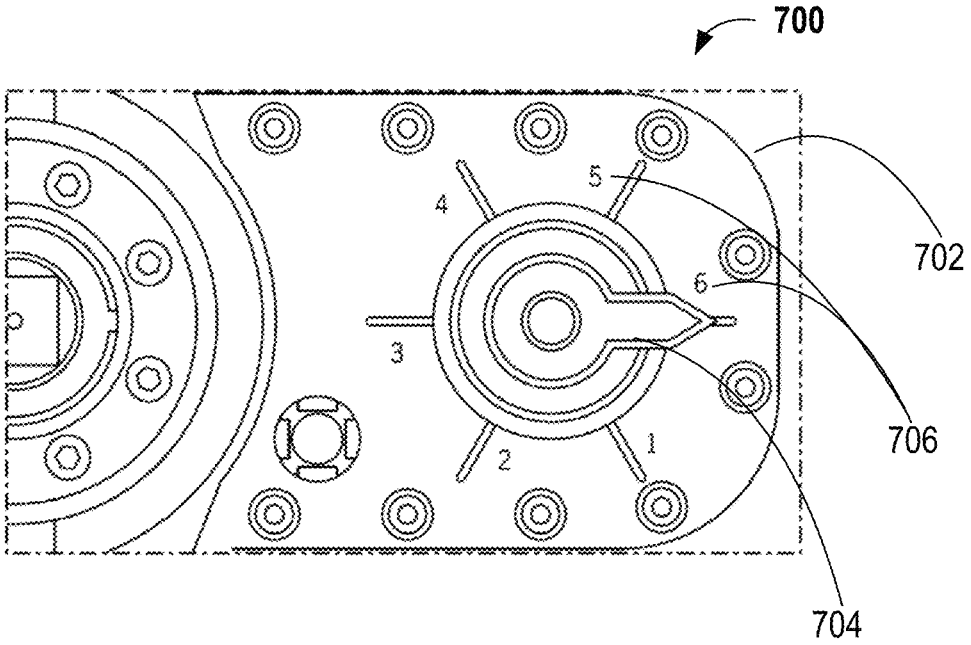
FIG. 7 is a system excerpt of a position indicator in an intervention subsystem to be used with one or more well slots in an oil and gas operation, in accordance with at least one embodiment.

FIG. 7 is a system excerpt 700 of a position indicator 704 in an intervention subsystem to be used with one or more well slots in an oil and gas operation, in accordance with at least one embodiment. As described with respect to FIG. 7, an identification of associated second passage-ways may be provided via markings 706 on a tab 702 that is on a top side of the intervention subsystem. Further, a position indicator 704 is a dial that may be provided in association with the markings 706 on the tab 702. The position indicator 704 may be used to indicate the association together of the at least two of the second passage-ways.

In FIG. 7 the position indicator 704 is at "6" to indicate that the selector has associated together (so that a path selector valve has aligned) a second passage-way of an intake port and a second passage-way of the number "6" outlet port ("B6" 224N of FIG. 2). Then a connected tie-in and associated access point (in a fluid block, a service bore, a production bore, a jumper, a tree, or other structure capable of receiving intervention fluid) to the number "6" outlet port will receive intervention fluid provided at the intake port of the intervention subsystem. In at least one embodiment, an electrical position indicator may be used to display a digital indication of the alignment of second passage-ways of the intervention subsystem. The electrical position indicator may be able to remotely or locally transmit a position indication to a receiving system, such as via radio frequency transmission. As such, the position indicator is mechanical, electrical, pneumatic, or other suitable indicator that may include a combination of such aspects.

Figure 8:
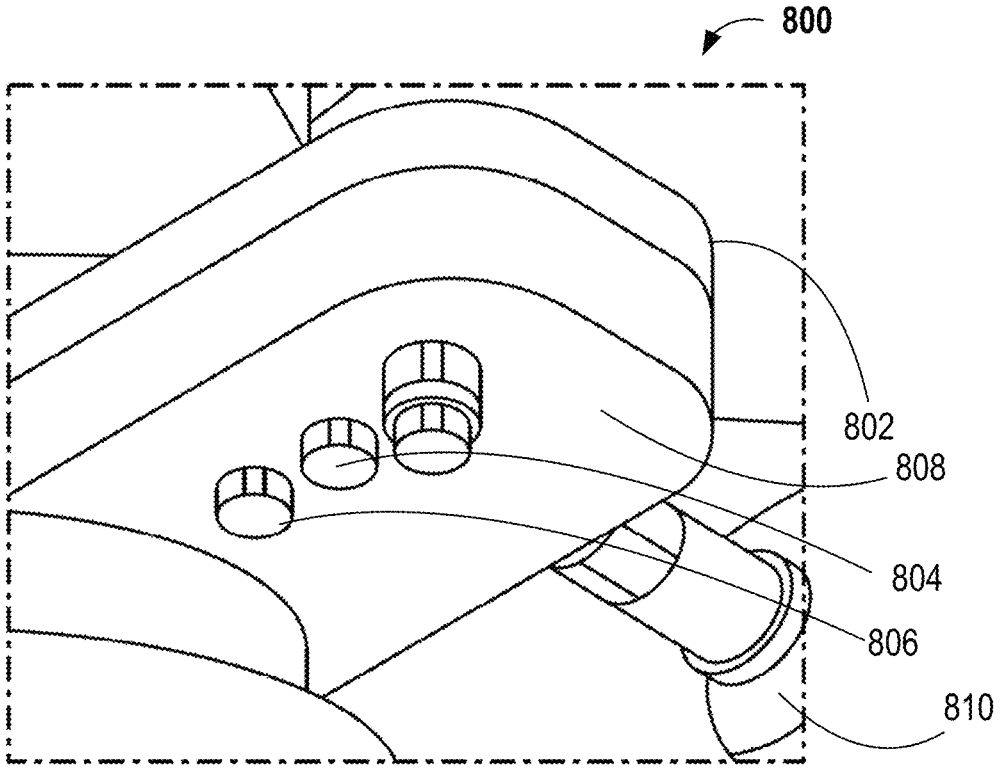
FIG. 8 is a system excerpt of relief valves in an intervention subsystem to be used with one or more well slots in an oil and gas operation, in accordance with at least one embodiment.

FIG. 8 is a system excerpt of relief valves 804, 806 in an intervention subsystem to be used with one or more well slots in an oil and gas operation, in accordance with at least one embodiment. The relief valves 804, 806 may be provided on the same tab 802 (reference numeral 702 of FIG. 7) as the position indicator or may be provided on a different part 808 of the intervention subsystem. The pressure relief valves of the intervention subsystem can enable inlet and outlet pressure relief from pressures associated with the compensation oil of the position indicator. For example, an oil compensator 810 may be provided in the intervention subsystem as a redundant or reservoir support to oil requirements of the position indicator.

Figure 9:
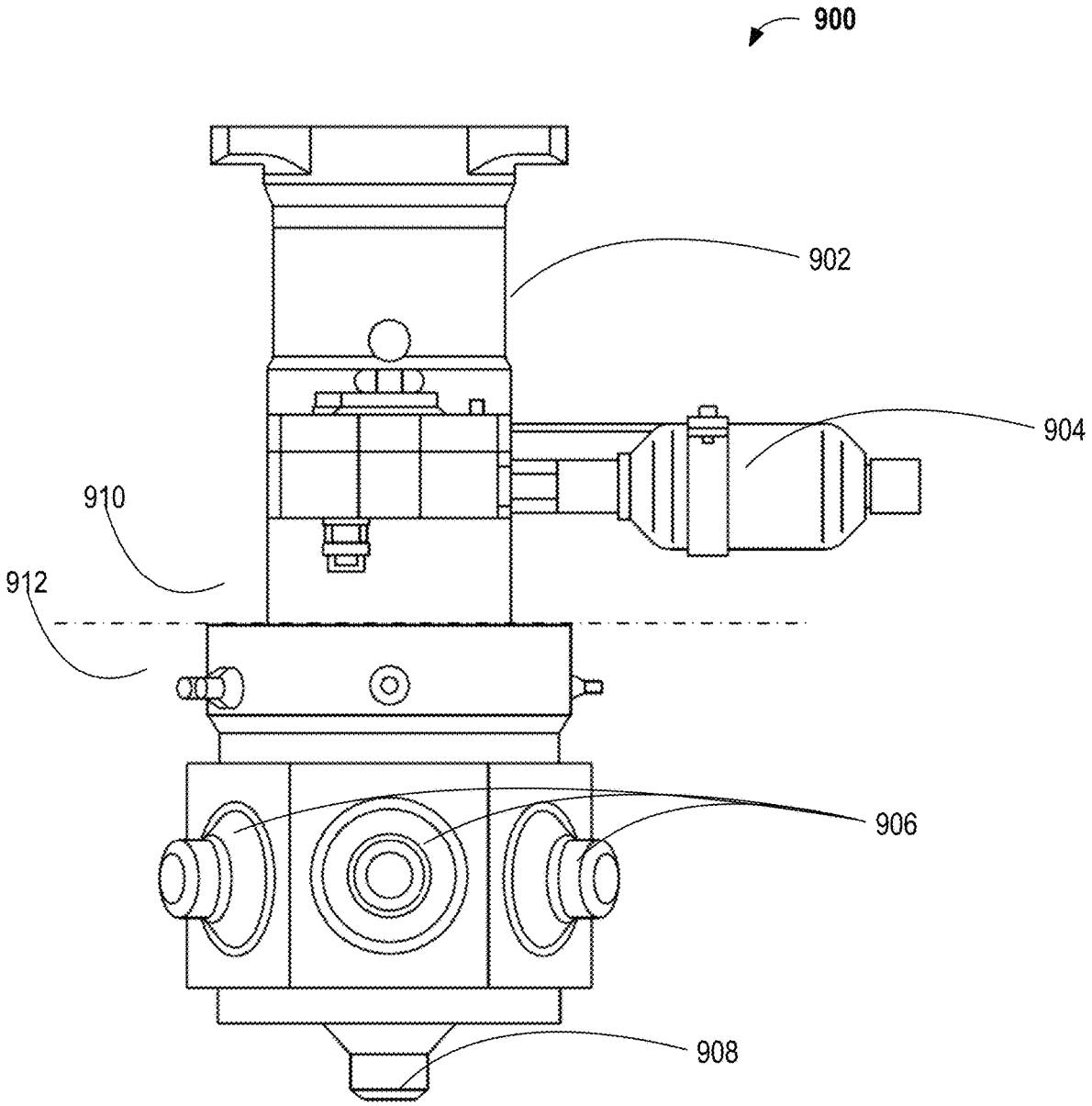
FIG. 9 is a side-view illustration of an intervention subsystem having a path selector valve to be used with one or more well slots in an oil and gas operation, in accordance with at least one embodiment.

FIG. 9 is a side-view illustration of an intervention subsystem 900 having a path selector valve to be used with one or more well slots in an oil and gas operation, in accordance with at least one embodiment. FIG. 9 illustrates the selector 902 that may be adjusted by an ROV; an oil compensator 904; and ports 906, 908 for intake and outlet of intervention fluid. Further, FIG. 9 illustrates that an external section 910 of the intervention subsystem 900 may be situated with access to an ROV and that may be associated with a fluid block via jumpers. This is so that the selector is operational by the ROV that moves within range of the intervention subsystem 900 in the drill center. An internal section 912 may be within a manifold (such as, a manifold 252 of FIG. 2), or other control apparatus of the drill site.

Figure 10:
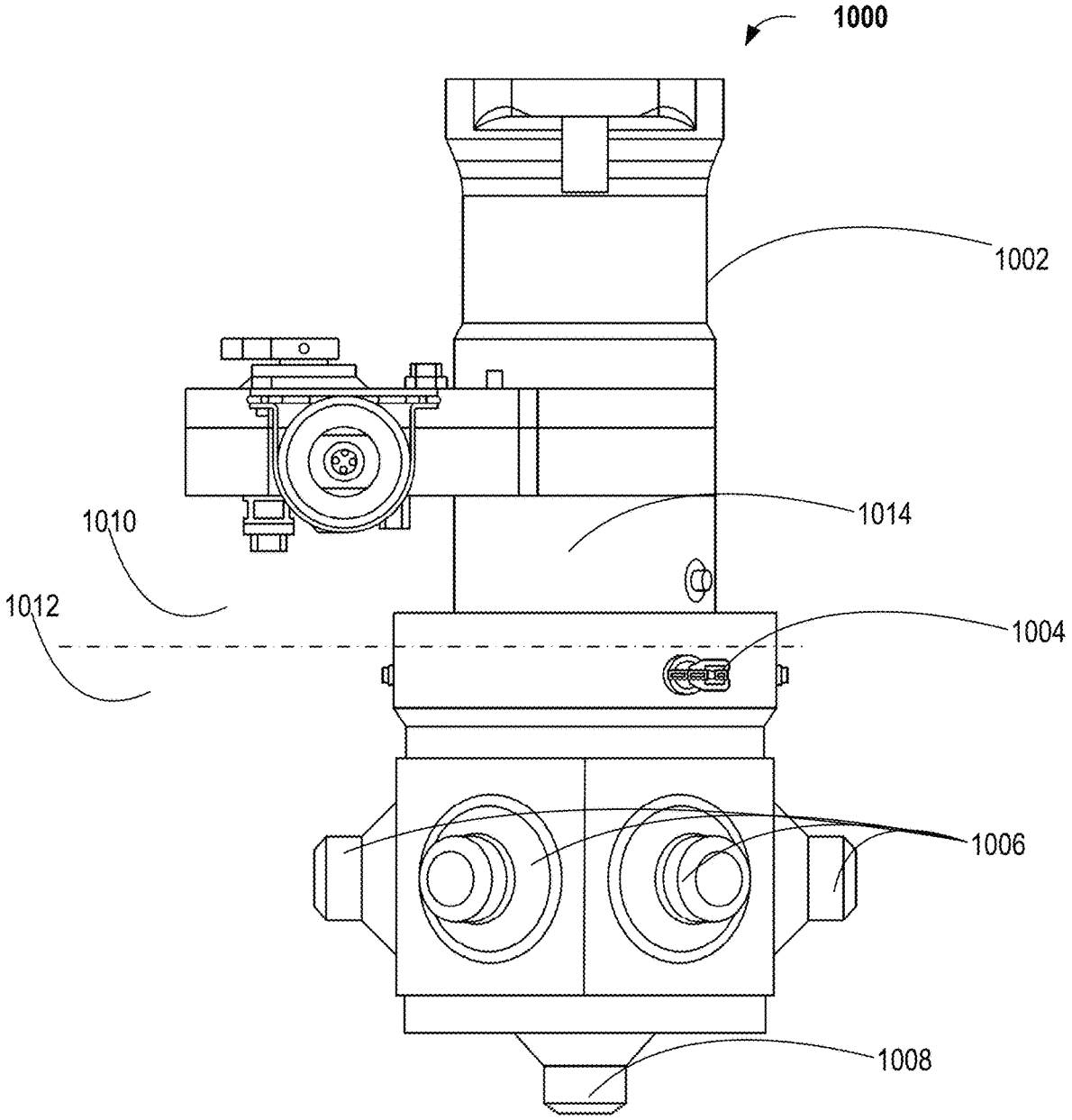
FIG. 10 is a different side-view illustration of an intervention subsystem having a path selector valve to be used with one or more well slots in an oil and gas operation, in accordance with at least one embodiment.

FIG. 10 is a different side-view illustration of an intervention subsystem 1000 having a path selector valve to be used with one or more well slots in an oil and gas operation, in accordance with at least one embodiment. Like in FIG. 9, FIG. 10 illustrates the selector 1002 that may be adjusted by an ROV and illustrates the ports 1006, 1008 that may be used for intake and outlet of intervention fluid. Further, FIG. 10 illustrates that an external section 1010 of the intervention subsystem 1000 may be situated with access to an ROV and that may be associated with a fluid block via jumpers. This is so that the selector is operational by the ROV that moves within range of the intervention subsystem 1000 in the drill center. An internal section 1012 may be within a manifold (such as, a manifold 252 of FIG. 2), or other control apparatus of the drill site. A label area 1014 is provided to include ratings and other features that describe the system for an operator. An eye-hook 1004 may be provided for moving the intervention subsystem 1000.

Figure 11:
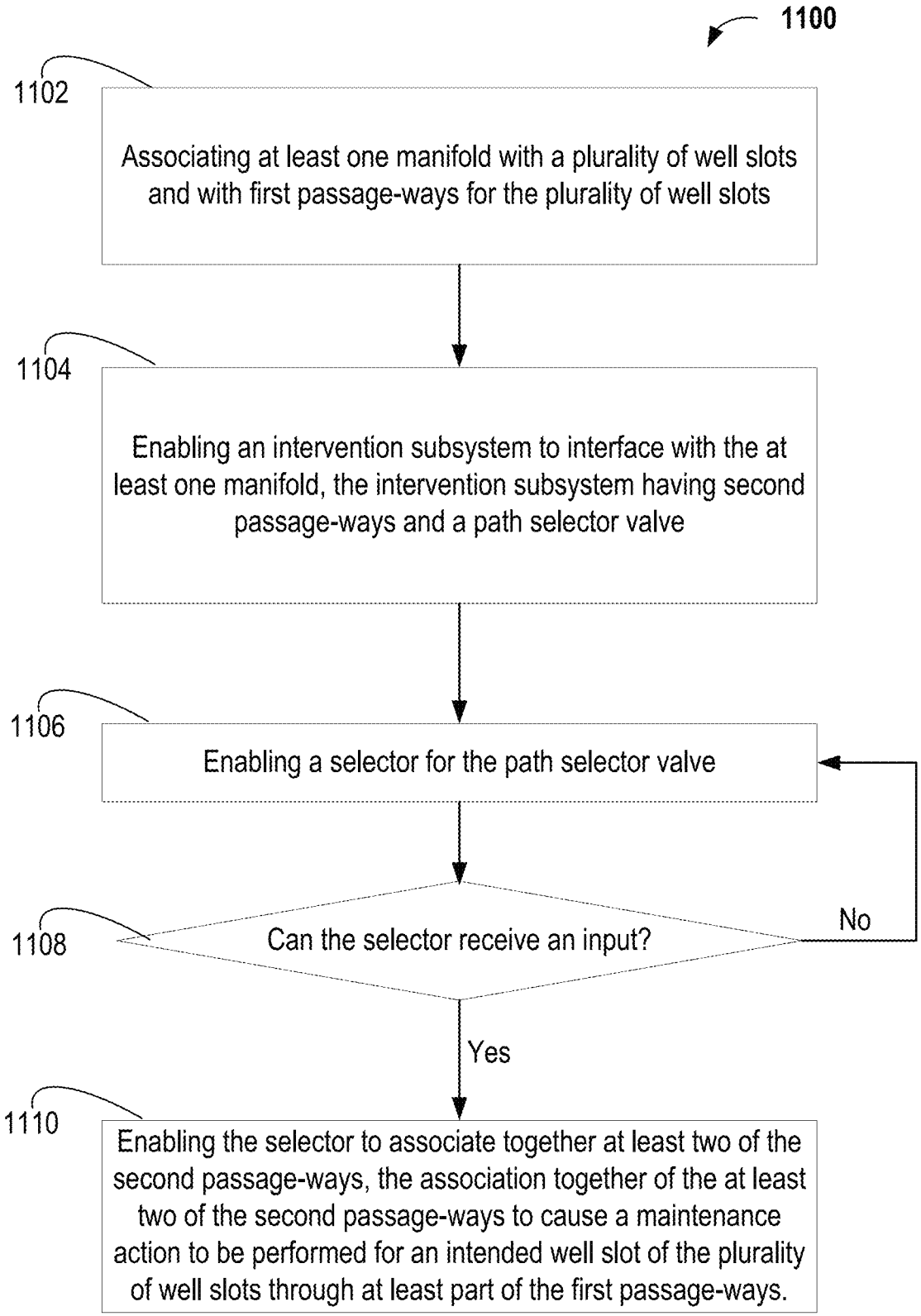
FIG. 11 illustrates a process flow for an example system as described with respect to one or more of FIGS. 1-10, in accordance with at least one embodiment.

FIG. 11A illustrates a process flow 1100 for an example system as described with respect to one or more of FIGS. 1-10, in accordance with at least one embodiment. The process flow 1100 may be used with a plurality of well slots in an oil and gas operation. The process flow 1100 includes a process or sub-process 1102 for associating a drill center with the plurality of well slots. The drill center includes at least one manifold having first passage-ways, which may be within a fluid block, within jumpers, a production or service line, a tree, or other components in a drill site and that are comprised in or that are distinct from the at least one manifold. In an aspect, the association may be connecting the tie-ins, jumpers, check valves, and other features described with respect to FIGS. 1-10.

The process flow 1100 includes a process or sub-process 1104 for enabling an intervention subsystem to interface within the drill center. The intervention subsystem includes second passage-ways and a path selector valve. The process flow 1100 includes a process or sub-process 1106 for enabling a selector for the path selector valve. In an aspect, the process or sub-process 1106 may be performed by coupling together a movable selector with the path selector valve. For example, the path selector valve may have a handle or a socket that is locked on to by an arm or feature forming a selector.

The process flow 1100 includes a process or sub-process 1108 for determining or verifying that the selector can receive an input. Otherwise, process or sub-process 1106 may be repeated. This ensures a proper coupling together of the selector and the path selector valve. The process flow 1100 includes a process or sub-process 1110 for enabling the selector to associate together at least two of the second passage-ways within the intervention subsystem. For example, as the selector is coupled to a path selector valve, an alignment of an intake port of the intervention subsystem and one of the many available outlet ports, by the path selector valve, associates together the at least two of the second passage-ways. Such an association together of the second passage-ways can cause a maintenance action to an intended well slot of a number of well slots available, through at least part of the first passage-ways of a manifold.

The process flow 1100 can include a process or sub-process for adapting the selector to be controlled via a remotely operable vehicle (ROV). A further a process or sub-process may be provided for enabling a position indicator of the intervention subsystem to indicate the association together of the at least two of the second passage-ways. Yet another process or sub-process may be include providing a number of ports on the intervention subsystem. At least one of the number of ports can support intake of the intervention fluid, and at least two sets of the number of ports can enable the second passage-ways to the plurality of well slots via the first passage-ways of the manifold. Another process or sub-process may be provided for associating check valves with the at least one fluid block so that the check valves can access the first passage-ways. The check valves can be enabled to receive the intervention fluid from the path selector valve and to pass the intervention fluid to the intended well slot.

Figure 12:
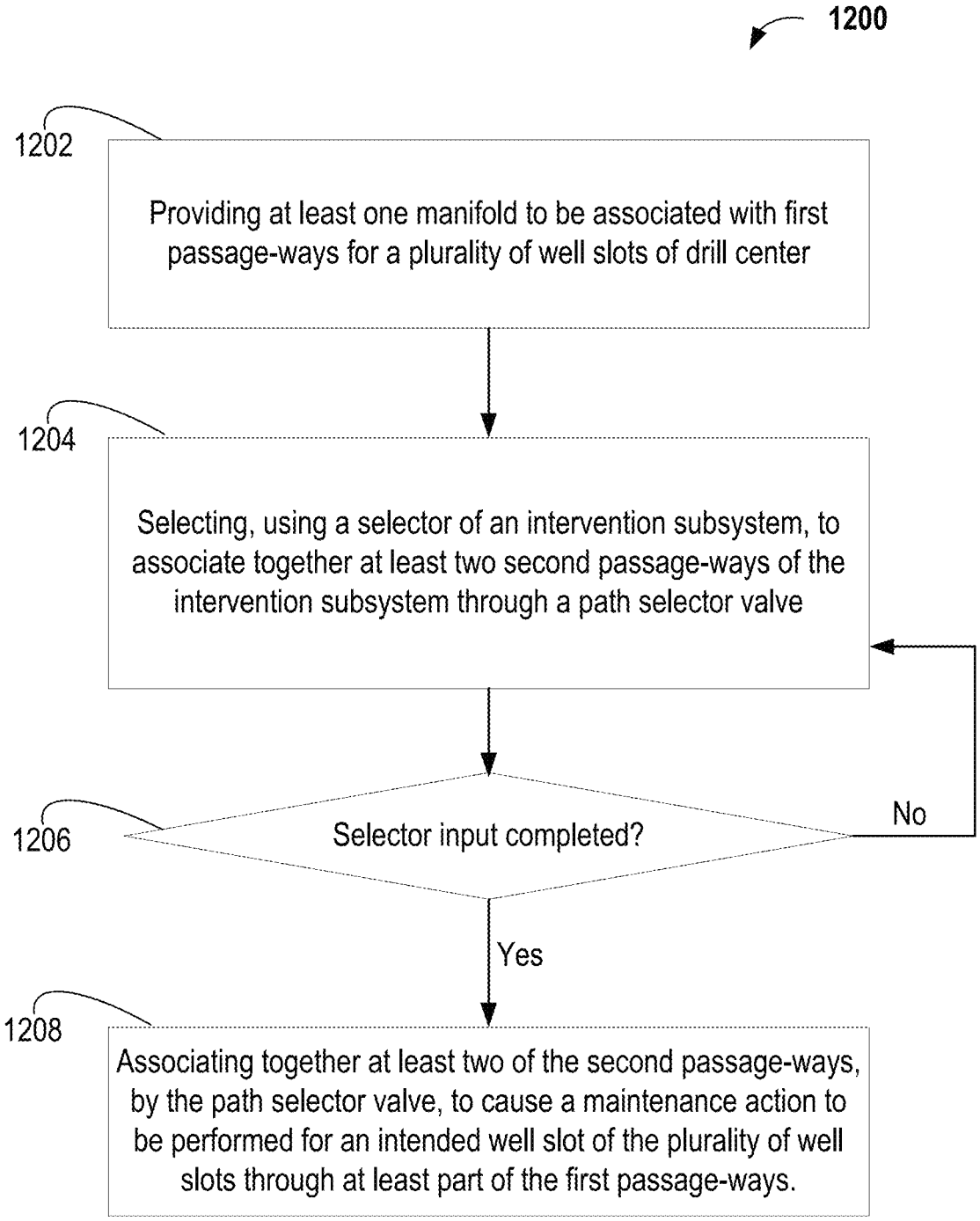
FIG. 12 illustrates another process flow for an example system as described with respect to one or more of FIGS. 1-10, in accordance with at least one embodiment.

FIG. 12 illustrates another process flow 1200 for an example system as described with respect to one or more of FIGS. 1-10, in accordance with at least one embodiment. The process flow 1200 may be used with a number of well slots in an oil and gas operation. The process flow 1200 includes a process or sub-process 1202 for providing a drill center with an intervention fluid connection to the number of well slots. The drill center includes at least one manifold having first passage-ways, but can include other first passage-ways that are distinct from the at least one manifold. The process flow 1200 includes a process or sub-process 1204 for selecting, using a selector of an intervention subsystem, to associate together at least two second passage-ways of the intervention subsystem through a path selector valve.

The process flow 1200 includes a process or sub-process 1206 for verifying or for determining that the selecting of process or sub-process 1204 is completed. The process or sub-process 1204 may be otherwise repeated. The process flow 1100 includes a process or sub-process 1208 for associating together the at least two of the second passage-ways to cause a maintenance action to an intended well slot of the plurality of well slots through at least part of the first passage-ways.

The process flow 1200 includes a process or sub-process for using a remotely operable vehicle (ROV) to control the selector. The process flow 1200 includes a process or sub-process for determining that the at least two of the second passage-ways are associated together from a position indicator of the intervention subsystem. The process flow 1200 includes a process or sub-process for providing hot stab tie-ins between outlets of the intervention subsystem and check valves of the well slots. The check valves may be associated with the at least one fluid block. Further, the check valves can receive the intervention fluid from the path selector valve and can pass the intervention fluid to the intended well slot. The process flow 1200 includes a process or sub-process for associating a chemical jumper to the intervention subsystem. A further process or sub-process may be for selecting the intended well slot using the selector. The selector can cause the path selector valve to enable an intervention fluid flow to the intended well slot through at least one check valve in one of the at least one manifold. Such a flow of intervention fluid may be part of the maintenance action.

The specification and drawings are, accordingly, to be regarded in an illustrative rather than a restrictive sense. It will, however, be evident that various modifications and changes may be made thereunto without departing from the broader spirit and scope of the disclosure as set forth in the claims. Further, any of the many embodiments disclosed here may be combined by a person of ordinary skill using the present disclosure to understand the effects of such combinations.

What is claimed is:

1. A system to be used with one or more well slots in an oil and gas operation, the system comprising:

at least one manifold associated with the one or more well slots and with first passage-ways for the one or more well slots; and an intervention subsystem comprising second passage-ways and a path selector valve, the path selector valve selectable to associate together at least two of the second passage-ways to enable a maintenance action to be performed for the one or more well slots through at least part of the first passage-ways.

2. The system of claim 1, wherein the maintenance action to be performed for the one or more well slots comprises one of or a combination of a chemical treatment, a depressurization process, a barrier integrity confirmation, an expansion of field process, or commissioning and maintenance of a well jumper process.

3. The system of claim 1, further comprising:

a position indicator of the intervention subsystem to indicate the association together of the at least two of the second passage-ways.

4. The system of claim 1, further comprising:

a plurality of ports on the intervention subsystem, at least one of the plurality of ports to support intake of an intervention fluid, and at least two sets of the plurality of ports to enable the second passage-ways to the one or more well slots.

5. The system of claim 1, further comprising:

check valves associated with the at least one manifold, the check valves to receive an intervention fluid from the path selector valve and to pass an intervention fluid to the one or more well slots as part of the maintenance action.

6. The system of claim 1, further comprising:

check valves comprised in the at least one manifold, the check valves to provide access to the first passage-ways, the access to the first passage-ways to allow a flow of an intervention fluid from the path selector valve of the intervention subsystem as part of the maintenance action.

7. The system of claim 6, further comprising:

an angled feature comprised in a fluid block within the at least one manifold, the angled feature comprised of one of the first passage-ways and an inlet of the fluid block, and the angled feature to support one of the check valves.

8. The system of claim 1, further comprising:

a selector of the intervention subsystem to enable the selectable feature of the path selector valve via a remotely operable vehicle (ROV).

9. The system of claim 1, further comprising:

ports of the intervention subsystem to associate one or more of a production well jumper or a service jumper to the one or more well slots.

10. The system of claim 1, further comprising:

pressure relief valves of the intervention subsystem to enable inlet and outlet pressure relief from pressures associated with a compensation oil of the position indicator.

11. A method to be used with a plurality of well slots in an oil and gas operation, the method comprising:

associating at least one manifold with the plurality of well slots and with first passage-ways for the plurality of well slots; and enabling an intervention subsystem to interface within the at least one manifold, the intervention subsystem comprising second passage-ways and a path selector valve; and enabling a selector for the path selector valve, the selector to associate together at least two of the second passage-ways, the association together of the at least two of the second passage-ways to enable a maintenance action to be performed for an intended well slot of the plurality of well slots through at least part of the first passage-ways.

12. The method of claim 11, further comprising:

adapting the selector to be controlled via a remotely operable vehicle (ROV).

13. The method of claim 11, further comprising:

enabling a position indicator of the intervention subsystem to indicate the association together of the at least two of the second passage-ways.

14. The method of claim 11, further comprising:

providing plurality of ports on the intervention subsystem, at least one of the plurality of ports to support intake of an intervention fluid, and at least two sets of the plurality of ports to enable the second passage-ways to the plurality of well slots.

15. The method of claim 11, further comprising:

associating check valves with the at least one manifold so that the check valves access the first passage-ways; and enabling the check valves to receive an intervention fluid from the path selector valve and to pass an intervention fluid to the intended well slot.

16. A method to be used with plurality of well slots in an oil and gas operation, the method comprising:

providing at least one manifold to be associated with first passage-ways for the plurality of well slots; and selecting, using a selector of an intervention subsystem, to associate together at least two second passage-ways of the intervention subsystem through a path selector valve, the association together of the at least two of the second passage-ways to enable a maintenance action to be performed for an intended well slot of the plurality of well slots through at least part of the first passage-ways.

17. The method of claim 16, further comprising:

using a remotely operable vehicle (ROV) to control the selector.

18. The method of claim 16, further comprising:

determining that the at least two of the second passage-ways are associated together from a position indicator of the intervention subsystem.

19. The method of claim 16, further comprising:

providing hot stab tie-ins between outlets of the intervention subsystem and check valves of the well slots, the check valves associated with the at least one manifold, the check valves to receive an intervention fluid from the path selector valve and to pass the intervention fluid to the intended well slot.

20. The method of claim 16, further comprising:

associating a chemical jumper to the intervention subsystem; and selecting the intended well slot using the selector, the selector to cause the path selector valve to enable flow of an intervention fluid from the chemical jumper to the intended well slot through at least one check valve in one of the at least one manifold.

* * * * *